United States Patent [19]

Kosfeld

[11] 3,945,220

[45] Mar. 23, 1976

[54] INJECTION COOLING ARRANGEMENT FOR ROTARY COMPRESSOR

[75] Inventor: Milton M. Kosfeld, Colts Neck, N.J.

[73] Assignee: Fedders Corporation, Edison, N.J.

[22] Filed: Apr. 7, 1975

[21] Appl. No.: 565,844

[52] U.S. Cl. ..... 62/505; 418/63; 418/97

[51] Int. Cl.[2] ..... F25B 31/00

[58] Field of Search ..... 62/505; 418/63, 97

[56] References Cited

UNITED STATES PATENTS

| | | | |
|---|---|---|---|
| 2,669,384 | 2/1954 | Dills | 418/63 |
| 2,883,101 | 4/1959 | Kosfeld | 418/63 |
| 3,105,633 | 10/1963 | Dellario | 62/505 |
| 3,109,297 | 11/1963 | Rinehart | 62/505 |

*Primary Examiner*—William O'Dea
*Assistant Examiner*—Ronald C. Capossela
*Attorney, Agent, or Firm*—Ryder, McAulay, Fields, Fisher & Goldstein

[57] ABSTRACT

Liquid refrigerant is injected into the high-pressure side of a rotary compressor so as to cool the refrigerant being compressed to allow it to be useful in cooling the compressor motor. The injection port is located on the bottom face of the compressor chamber, within an area removed from the compressor chamber wall, immediately adjacent the compressor chamber discharge. The feed to the injection port is through a larger tube containing two non-connected capillaries, the first capillary being connected to the inlet of the tube and the second capillary being connected to the injection port. In this manner, a column of liquid remains in the second capillary. The combination of the placement of the injection port and the form of the inlet tubing to the injection port prevents liquid from being carried over into the suction side of the compressor, where efficiency and economy would be diminished, avoids the necessity for a check valve in the suction line to the compressor chamber, and allows for the parts of the compressor chamber to be used with varying compressor rollers without remachining.

4 Claims, 2 Drawing Figures

INJECTION COOLING ARRANGEMENT FOR ROTARY COMPRESSOR

BACKGROUND OF THE INVENTION

With compressors in general, and rotary compressors in particular, both the operating mechanism of the compressor and the motor for driving this operating mechanism are located within a sealed, hermetic casing. Because of this arrangement, some provision must be made for cooling of the motor or it will become damaged by overheating. One manner of doing this, generally accepted by the prior art, is to conduct the compressed refrigerant from the compressor chamber over the motor so as to provide cooling. However, generally, in the compression operation, the refrigerant is heated to such a point that it does not effectively cool the motor. Accordingly, to overcome this, liquid refrigerant from the condensation stage is frequently admixed with the compressed refrigerant before it is conducted over the motor.

Because of the high pressure on the discharge side of the compressor chamber and, particularly, the varying pressure within this chamber, care has to be taken as to the point of introducing or injecting this liquid refrigerant into the compressor. Care must also be taken that this liquid refrigerant is now carried over into the suction side of the compressor where it would decrease the efficiency of the compressor and thus its economy of operation.

One structure employed for the introduction of liquid refrigerant into the compressed refrigerant, for the purpose of cooling that compressed refrigerant, is shown in Rinehart, U.S. Pat. No. 3,109,297. According to that patent, a liquid discharge inlet 31 is located on the lower face of the compression chamber and, except for a portion of the cycle, that injection port is covered by the face of the roller which moves in an eccentric motion around the compression chamber. While this location of the injection port has frequently proven effective, it is so close to the vane which separates the high- and low-pressure sides of the compressor that there is great danger of the liquid refrigerant being carried over to the suction side of the compressor, thus diminishing its efficiency. In addition, the face of the compressor must be separately machined for each roller size, as the time of uncovering of the injection port is totally dependent upon the size of the roller.

BRIEF DESCRIPTION OF THE INVENTION

According to the present invention, a generally standard rotary compressor is provided. This compressor has, within a hermetically sealed casing, an electric motor for driving the operating parts of a compressor. Attached to the motor casing, by means well known in the art, are a compression chamber including upper and lower flat faces, and a generally circular wall. Within the compression chamber is a roller which moves about the wall of the chamber under the action of an eccentric driven by the motor. Also provided as a part of the compressor casing are a suction inlet for gas to be compressed, an outlet for compressed gas, and a slideable vane, urged to bear against the roller in its various positions, which separates the suction and discharge sides of the chamber. As the roller moves from the suction port, it continually compresses the gas which it then forces out at the discharge port. The structure and operation thus far described are generally standard in rotary compressors.

With the construction of the present invention, a portion of the compressor chamber wall at the entrance to the discharge port is removed, as by milling, or the wall is formed with a depression in the wall at that point. An opening is drilled in the lower case of the compressor chamber, within this depression, to provide for the entrance of liquid refrigerant to be used in cooling of the compressed refrigerant.

This opening is in contact, at the outside of the compressor chamber, with a piece of tubing adapted to carry liquid refrigerant from a condensing portion of the overall refrigeration system. Two capillaries are provided in this tube, one adjacent its inlet and one adjacent the compressor chamber. A gas pocket will form in the portion of the outer tubing immediately surrounding the capillary adjacent the compressor chamber, that gas pocket acting to smooth out vibrations in liquid flow caused, particularly, by alternating injections of liquid refrigerant to the compressor chamber. A head of liquid will, however, remain in both of the capillaries and in that portion of the larger tube between the capillaries and surrounding the entrance capillary.

When the pressure within the compressor chamber is lower than that of the liquid being fed from the condenser to the injection port, that liquid normally being at about 280 pounds pressure, liquid will be injected into the compressor chamber. When the pressure in the compressor rises above the liquid refrigerant pressure, there will be a tendency for the liquid refrigerant to be driven back into the feed tube. However, because of the inertia of the liquid column previously described, it will not be moved far enough for any substantial portion of the compressed gas in the high-pressure side of the compressor chamber to be lost.

Because of the location of the liquid injection port essentially within the discharge outlet, there is little, if any, danger of the liquid being carried over to the low-pressure side of the compressor, as is entirely possible with prior art arrangements. Thus, there is no diminishment of compressor efficiency or economy. Further, because of the particular location of the injection port, varying compressor roller sizes can be employed without the necessity for re-machining the injection port or its area of entry.

DESCRIPTION OF THE PREFERRED EMBODIMENTS

Figure 1:
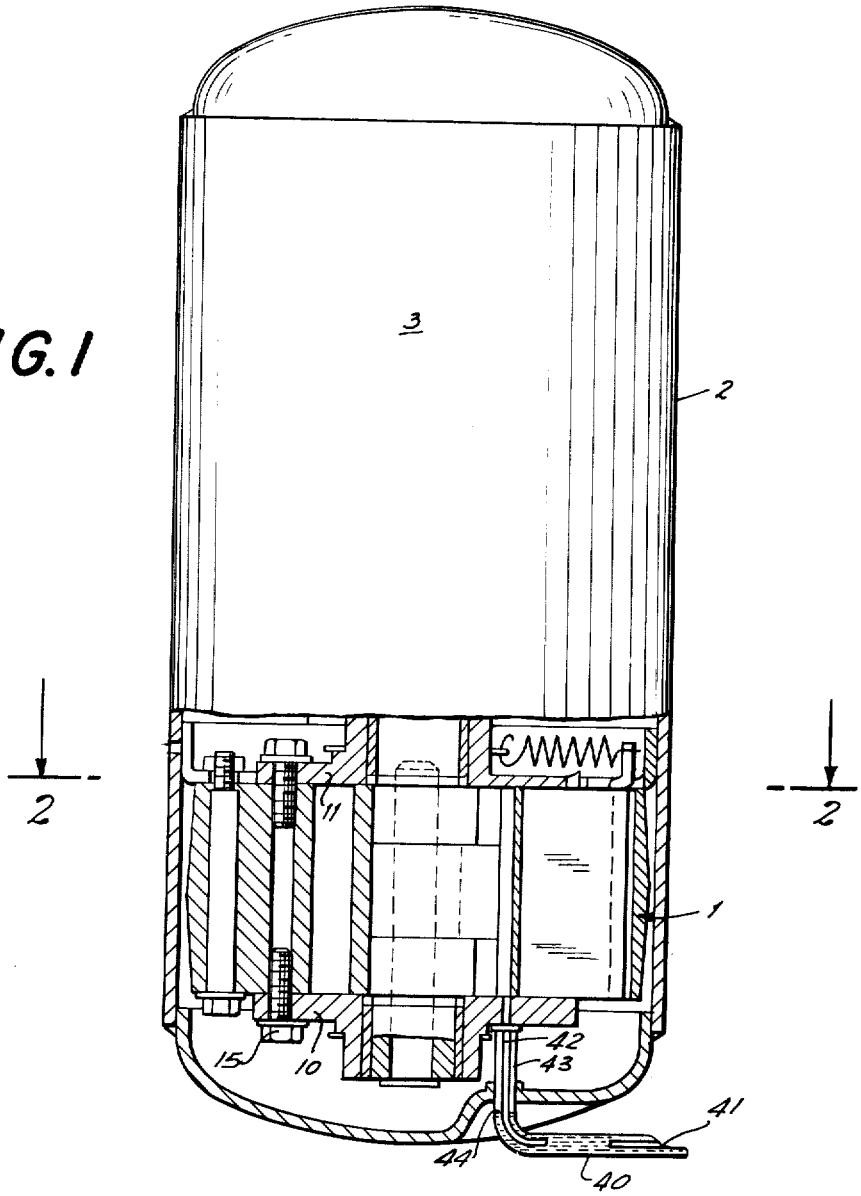
FIG. 1 is a plan view, partially in section, of a compressor, including a hermetic casing.

Referring to the accompanying drawings, a compressor 1 is shown as mounted within a hermetic casing 2. Within the upper portion of hermetic casing 2, designated 3, a motor for driving the operating parts of the compressor is located. The suction inlet port to the compressor is shown at 4, and the compressed refrigerant outlet at 5. As well known in the art, the refrigerant from the outlet may be conducted directly to the motor chamber 3 for cooling of the motor.

The compressor includes a lower face plate 10, an upper face plate 11, and a member 12 to define the chamber wall 13, these three pieces defining the compression chamber 14. The lower face plate 10, upper face plate 11, and member 12 are connected by one or more bolts 15. Means for mounting of the compressor to the motor frame or to the case 2 are well known in the art.

Figure 2:
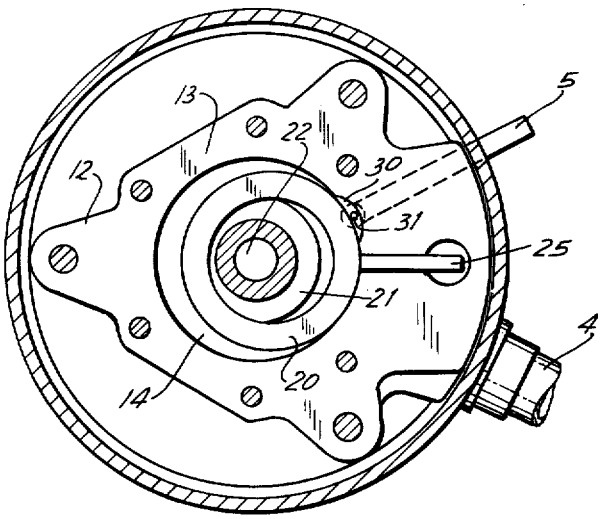
FIG. 2 is a sectional view along the line 2—2 of FIG. 1.

Mounted within the compressor chamber 14 are a roller 20 an eccentric 21, and a portion of the motor shaft 22 which drives the eccentric and, therefore, the roller. Because of the manner of mounting and driving, as the roller moves in a clockwise direction, as illustrated in FIG. 2, a portion of it is always in contact with wall 13 of the compression chamber, except when it is adjacent the discharge outlet. Also provided is a vane 25 which is urged, by means not shown, into contact with the face of the roller so as to provide a suction side and a discharge in the compression chamber.

A recess 30 is formed in the portion of the wall 13 at the discharge outlet. The size of this recess is not critical and need merely be large enough to accommodate the opening 31 for the injection of liquid refrigerant. The recess can be formed, for example, merely by milling out that portion of the wall in the member 12 adjacent the discharge port.

The liquid for injection through opening 31 is carried to that opening through tube 40 within which are formed a first capillary 41, attached to the inlet, and a second capillary 42, the latter being attached to the opening 31. The liquid refrigerant is conducted to tube 40 from a condensing portion of the overall refrigeration system (not shown) of which the compressor is a part. A portion of the liquid refrigerant entering the tube 40 will form a gas pocket 43 above the liquid level 44 shown in the tube. This gas pocket 43 will act to take up the surges caused by liquid entering the compressor chamber and the back pressure caused by compression of the gas within the chamber to a pressure above that of the liquid in tube 40. The capillary 43, however, is filled with liquid, the level 44 defining the liquid level in the space between capillary 43 and tube 40.

In operation, gaseous refrigerant to be compressed will enter compressor chamber 14 through inlet 4. The roller 20, starting from a point where its high side is adjacent vane 25 will move clockwise, as defined by its high point moving along wall 13. During the first approximately 240° of movement, the inlet 31 will be in communication with the high-pressure side of the chamber 14, but the pressure in that high-pressure side will be less than the pressure of the liquid refrigerant, which is about 280 pounds. Thus, liquid refrigerant will be injected into the high side of the compressor for mixing with the gas being compressed. The cooler temperature of the liquid refrigerant entering the compression chamber, as well as the evaporation of a portion of this refrigerant, will result in a cooling of the gas being compressed. As the pressure on the high-pressure side becomes great enough, the outlet valve (not shown) will open, allowing the gas to be forced through outlet 5.

The location of the liquid injection port 31 in recess 30, as opposed to placing it below the roller, has a number of advantages. As a first matter, even absent the liquid injection port, the roller will lose its seal with the side wall of the compression chamber at the outlet port. Thus, forming the recess at that point, there are no additional places where the seal is lost. Further, the tendency is for the liquid being injected either to enter the high-pressure side of the compression chamber or to be directly discharged through the outlet. In the prior art systems, where the port was placed between the outlet and the vane, there was great danger of the liquid carrying over to the low-pressure side of the compressor, thus reducing its efficiency and the economy of operation.

As is apparent, there will be a point during operation of the compressor, on each cycle, when the pressure in the high-pressure chamber is greater than the pressure of liquid being fed through the injection port. The tendency, during that small portion of the cycle, will be for the high-pressure gas to be forced back through the injection port. However, the standing column of liquid formed by the combination of tube 40 and capillaries 41 and 42 provides sufficient inertia that there is only a small backward movement of this column, and that movement is not sufficient to seriously reduce the efficiency of operation of the compressor.

The placement of the injection port in the manner described, and the overall construction of this injection port and its feed tube, allows for elimination of the check valve which is normally necessary in the suction line to the compressor chamber. As is well known, the compressor will generally not operate continually. Rather, there will be times during operation of the refrigerating system when the compressor will be shut down. At the time of shutdown, because of the differential gas pressures in the compression chamber, there is a tendency for the compressor roller to "run backwards." In prior art systems, such as shwon in previously referenced U.S. Pat. No. 3,109,297, as the roller ran backwards, the injection port would be periodically covered and uncovered by the moving roller. Under those circumstances, there would be intermittent entry of liquid refrigerant which would then vaporize and continue the backward movement of the roller.

It is most desirable during a compressor shutdown to equalize the compressor chamber pressure as quickly as possible. The intermittent admission of compressed refrigerant in the prior art systems did not allow this without placement of the check valve in the suction line to the compression chamber, as just described. Hwoever, with the present system, where the injection port is now covered by the roller, liquid refrigerant will enter the chamber at the time of shutdown and will cause the roller to run backward. However, when the roller has reached the point that the suction inlet is uncovered, it will be in contact with the injection port, and pressure will be, essentially, instantaneously equalized. This is most desirable from a standpoint of compressor life as it avoids the vibrations caused by the continued firing and backward movement of the roller.

In accordance, herewith, a novel structure for use in injecting liquid refrigerant into a compressor so as to cool the compressed refrigerant and allow it to be employed for cooling of the compressor motor, located within the same hermetic casing, has been shown and described. The invention should not be considered as limited to the specific embodiments shown and described but only as limited by the appended claims.

I claim:

1. In a rotary compressor having a compression chamber formed by a lower face plate, an upper face plate, an an intermediary wall-defining means, an eccentrically driven roller, a motor for driving said roller, and a vane urged into contact with the surface of said roller so as to divide said compression chamber into high- and low-pressure sides, a refrigerant inlet in contact with said low-pressure side, and a refrigerant outlet in communication with said high-pressure side, said outlet connecting with said wall-defining means, the improvement which comprises a recess formed in said wall-defining means at the entrance to said refrigerant outlet and a liquid refrigerant injection port formed in the lower face plate of said compressor chamber within said recess.

2. The compressor of claim 1 wherein said liquid refrigerant injection port is in fluid communication with the condensing portion of a refrigerant system of which the compressor forms a part, through a connecting tube.

3. The compressor of claim 2 wherein a capillary tube is located within said connecting tube in the area closest to said liquid refrigerant injection port, said capillary tube being in direct contact with said liquid refrigerant injection port.

4. The compressor of claim 3 wherein a further capillary tube is located within said connecting tube, said further capillary tube being connected to the inlet of said connecting tube, there being no contact between said capillary tubes.

* * * * *

UNITED STATES PATENT OFFICE

CERTIFICATE OF CORRECTION

PATENT NO. : 3,945,220

DATED : March 23, 1976

INVENTOR(S) : Milton M. Kosfeld

It is certified that error appears in the above-identified patent and that said Letters Patent are hereby corrected as shown below:

at Col. 1, line 26 the word "now" should be --not--.

at Col. 2, line 31 insert the word --chamber-- before the word "compressor" and after the word "rises."

at Col. 4, line 31 the word "shwon" should be --shown--.

at Col. 4, line 44 the word "hwoever" should be --however--.

at Col. 4, line 45 the word "now" should be --not--.

at Col. 4, Claim 1, line 65 the word "an" first occurrence should be -- and --.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*